United States Patent [19]

Royer

[11] 4,129,968

[45] Dec. 19, 1978

[54] MODULAR CONSTRUCTION ELEMENT

[76] Inventor: Fernand Royer, 15 Grand'rue, Sarry, 51000 Chalons sur Marne, France

[21] Appl. No.: 808,443

[22] Filed: Jun. 21, 1977

[30] Foreign Application Priority Data

Jun. 28, 1976 [FR] France ..... 76 19617

[51] Int. Cl.[2] ..... E04H 1/12; E04B 1/36

[52] U.S. Cl. ..... 52/79.1; 52/259; 52/264; 52/410; 52/438; 52/584

[58] Field of Search ..... 52/79.1, 583, 584, 438, 52/263, 79.14, 408, 410, 251, 259, 264, 265, 126

[56] References Cited

U.S. PATENT DOCUMENTS

| | | | |
|---|---|---|---|
| 1,612,734 | 12/1926 | Knight | 52/410 X |
| 1,847,820 | 3/1932 | De Montalk | 52/408 |
| 3,000,144 | 9/1961 | Kitson | 52/259 X |
| 3,377,755 | 4/1968 | Stucky | 52/79.14 |
| 3,394,522 | 7/1968 | Maurer | 52/583 |
| 3,474,582 | 10/1969 | Wah | 52/263 |
| 3,828,504 | 8/1974 | Egerborg | 52/410 |

FOREIGN PATENT DOCUMENTS

| | | | |
|---|---|---|---|
| 1400050 | 4/1965 | France | 52/79.1 |
| 438646 | 12/1967 | Switzerland | 52/259 |

*Primary Examiner*—John E. Murtagh
*Attorney, Agent, or Firm*—Lewis H. Eslinger

[57] ABSTRACT

The invention relates to a modular element used in the construction of buildings, constituted by a floor, a ceiling and vertical walls extending between the floor and the ceiling so as to define at least one parallelepipedic box-shaped compartment, the interior of which may be entirely finished, wherein the floor is constituted by a reinforced concrete slab covered by a layer of supple material on which rests a false floor or layer, connected to the vertical walls at their base, dismountable fixing means being provided between said slab and said false floor at least in each of the angles of the element.

16 Claims, 11 Drawing Figures

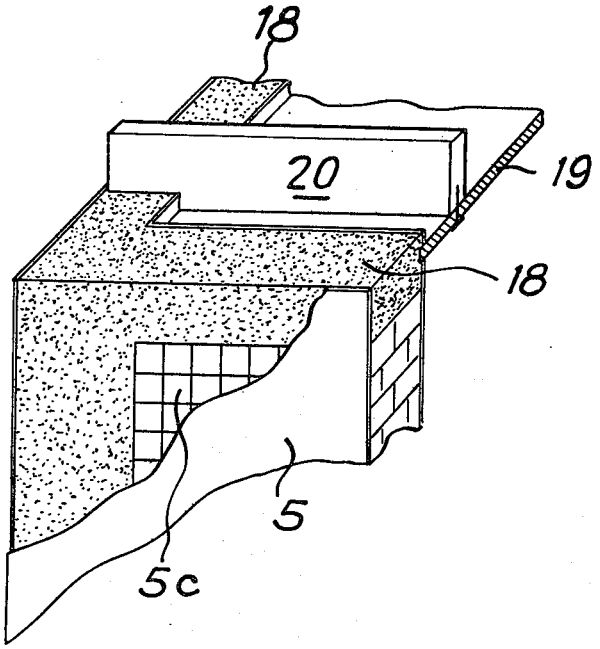
FIG. 5
FIG. 6
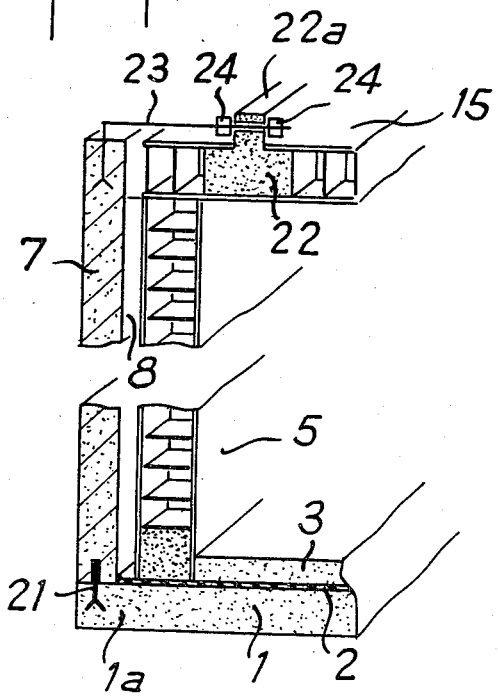
FIG. 7a
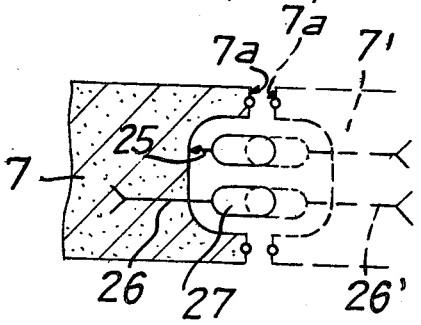
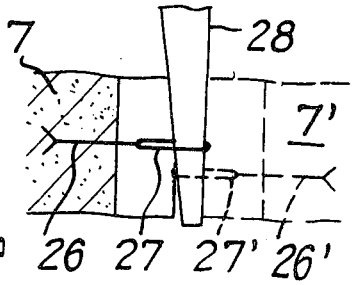
FIG. 7b

MODULAR CONSTRUCTION ELEMENT

The present invention relates to a modular construction element and more particularly to a modular element for constructing a dwelling, which may be made in the factory and erected, completely finished, on the site of construction of the dwelling, which will in this case be composed of a plurality of modular elements according to the invention which have been juxtaposed and joined together.

It is known to construct buildings from pre-fabricated elements and particularly from elements constituting a basic module of standardised dimensions, in the form of a box.

The present invention relates more especially to a box-shaped element, which is simple, rapid and inexpensive to construct.

To this end, the element according to the invention is constituted by a floor, a ceiling and vertical walls extending between the floor and the ceiling so as to define at least one parallelepipedic compartment, the interior of which may be entirely finished. According to one of the features of the invention, the floor is constituted by a reinforced concrete slab covered with a layer of supple material on which rests a false floor or layer, connected to the vertical walls at their base, dismountable fixing means being provided between said slab and said false floor at least in each of the angles of the element. In addition, the said element rests, after construction, on a support structure by means of at least four jacks which are fast therewith.

In a first embodiment of the invention, the vertical walls are made of a composite material, comprising two panels between which extends an internal reinforcement constituting a network of cross-pieces, these walls being connected together by vertical posts cast and solidified in spaces made in each of the adjacent edges of adjacent walls by partial raking away of the said network of cross-pieces, the connection of said walls with the false floor being made by means of fastening means fast with the false floor cooperating with a reinforcement placed in a space made at the base of said walls by removal of its internal reinforcement, and filled with a solidifiable binding agent.

In a second embodiment, the vertical walls are obtained in one piece by moulding on the layer provided with fastening means.

Finally, a facade panel is erected along a vertical wall, is anchored at its base on a projecting part of the slab and defines with said wall a zone of insulation.

The invention will be more readily understood on reading the following description with reference to the accompanying drawings, in which:

FIG. 1 is a schematic partial view in section of a modular element according to the invention;

FIGS. 2 and 3 schematically illustrate a first embodiment of the vertical walls of the modular element according to the invention.

FIG. 5 illustrates the fixing of a second type of ceiling on vertical walls according to FIGS. 2 and 3;

FIG. 6 illustrates the positioning of a facade panel.

FIGS. *7a*, *7b*, *8a*, *8b* and 9 illustrate types of connecting means fast with a modular element allowing it to be joined to adjacent modular elements.

Figure 1:
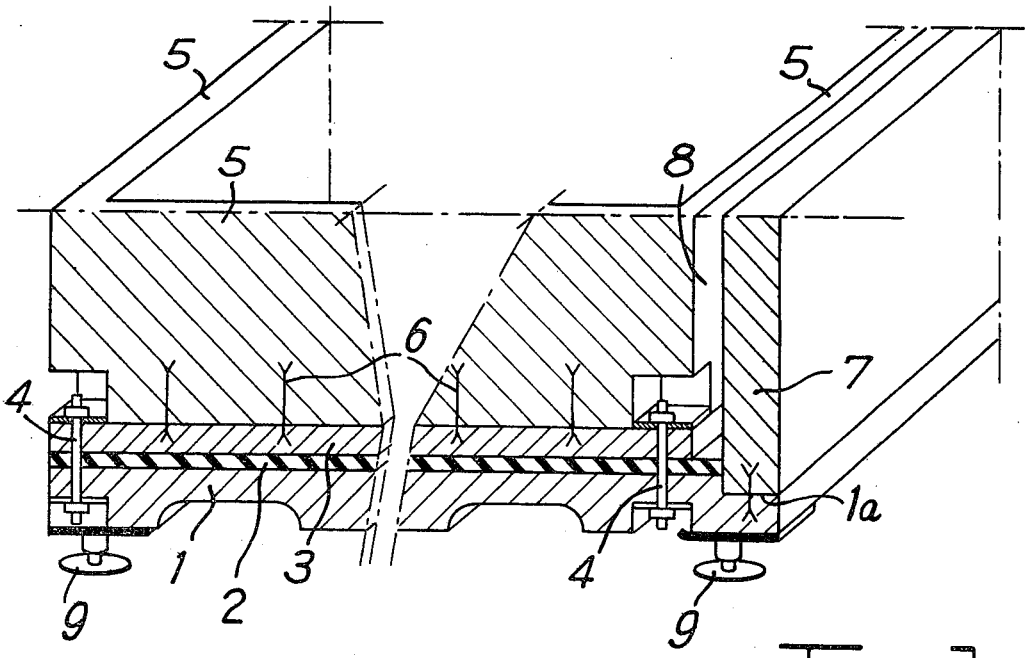

Referring now to the drawings, FIG. 1 shows the base of a modular element cut through a median plane of a vertical wall. This element is constituted by a reinforced concrete slab 1, coated with a supple material 2 (e.g. expanded polystyrene), on which has been cast or added a false floor or layer 3 which is made of reinforced or non-reinforced concrete or any other material. The connection between this layer 3 and the slab 1 is ensured by fixing means (shown here as bolts 4) placed at the four angles or corners of the modular element. Vertical walls 5 are then erected on the layer 3. In this Figure, they are made by casting in one piece on fastening means 6 previously provided in the layer 3. The moulds are in this case constituted by removable panels erected on the layer 3 and concrete, plaster or any other composite material is cast through the bottom and under pressure. The ceiling (not shown) of the element may either be integral by being cast therewith, or may be prepared in advance and placed on the top of the vertical walls before casting and have elements to ensure its anchoring in the cast material, or it may be added after the vertical walls have been erected. In the first two cases, it is obvious that internal moulding panels must be of such dimensions as to be compatible with the dimensions of the openings which the walls of such an element must imperatively comprise, in order to allow removal thereof from the mould.

It will be noted in FIG. 1 that, at the base of said walls and in the angles, plumb with the bolts 4, recesses are provided so as to render said bolts accessible for dismantling or at least loosening thereof. It should also be noted that the slab 1 has a portion 1*a* forming outer flange constituting the seating of a facade wall 7 which may be mounted either during erection of the walls 5, or subsequent to the positioning of the modular element on its site of construction. Between this wall 7 and the wall 5 which is parallel thereto, there is provided an insulation zone 8 possibly for placing an insulating material. In the erection of the vertical walls by casting, it is advantageous to erect the wall 7 and to fit it with its insulating means before proceeding with casting. The elements 7 and 8 may then constitute either the inner coating of the outer moulding panel, or the moulding panel itself.

Finally, the slab 1 rests on a support structure for example the ground, foundations (not shown), by means of jacks 9, for example screw jacks.

When the element is constructed, the slab 1 has firstly been placed on its jacks 9, then fitted with the supple material 2 and its false floor 3 and the vertical walls are finally erected. When the assembly is solidified and joined, its interior is arranged. All these operations are effected in the factory. Then, after the bolts 4 have been loosened, the element is raised by means of slings and a lifting device, by the corners provided with jacks and is placed on a transport vehicle. Finally, by the same means, it is deposited on the foundations which have been made on the side of construction and on which it rests by its jacks 9. The bolts 4 are retightened.

It is seen that, as soon as it is constructed and until it is placed in position, the element is always subjected to the same type of stresses, due to its own weight, since the effect of this weight is always supported at the same spot either by the jacks 9 or by the suspension members of the lifting device. There are therefore no modifications in the state of the stresses, thus no risk of creating cracks. In addition, the fact of having disconnected the slab 1 from the rest of the element by loosening the bolts 4 adds to this advantage. In fact, during transport, local excess loads may be produced by inertia on the slab 1 which will be absorbed by the supple material 2 without being transmitted to the rest of the element. Furthermore, the jacks 9 allow the levelling of the element itself, at the same time as the adjustment of its level with that of the elements which are juxtaposed with respect thereto.

Figure 3:
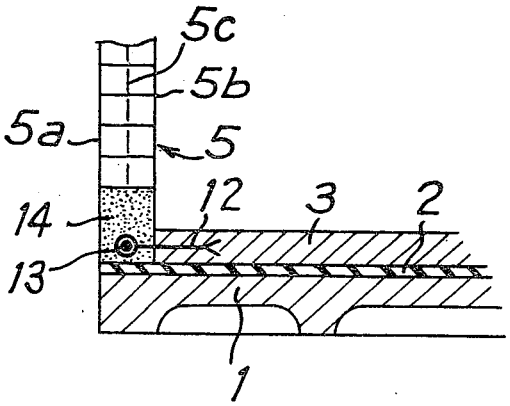
Figure 2:
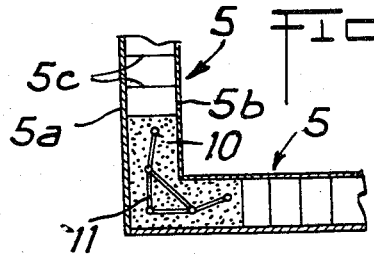

In another embodiment of the invention, illustrated in FIGS. 2 and 3, to constitute a modular element, the vertical walls 5 are formed by erecting and maintaining erected by any suitable means on the material 2, panels made of composite material, comprising two thin plates 5*a* and 5*b* generally made of plaster, between which extends an internal reinforcement constituting a network of cross-pieces 5*c* particularly designated in France under the Registered Trademark "PLACOPLATRE." These vertical panels were previously provided with the openings which they must comprise (doors, windows, . . . ) and their side edges have been cut, as shown in FIG. 2, so that they can be adjacent by mitring. In addition, along these prepared edges, a partial raking away has been effected of the cross-piece structure so as to arrange a free space between the two plates 5*a* and 5*b* of each panel.

To connect said walls 5 together, it is then sufficient to cast a binding agent 10 in the free space mentioned above, through the top, which, once solidified, will constitute a post for holding the walls 5. This binding agent will naturally fill the free spaces in the panels. It is, of course, possible, before casting said binding agent, to arrange a reinforcement 11 in the free spaces so as to constitute reinforced posts.

The vertical walls 5 are connected to the layer 3 by means of fastening means 12 with eyes, fixed in the edges of the layer 3, cooperating with a reinforcement 13, housed in a space 14 made at the base of the wall by raking away part of the network of cross-pieces 5*c* existing between the two plates 5*a* and 5*b*. This space is then filled with the binding agent 9 (e.g. plaster) when it is cast from the top part of the walls in said vertical spaces (FIG. 2). In these Figures, the layer 3 may be divided into a plurality of independent elements between which are placed the bases of the vertical walls constituting the intermediate partitions of the element according to the invention.

Figure 4:
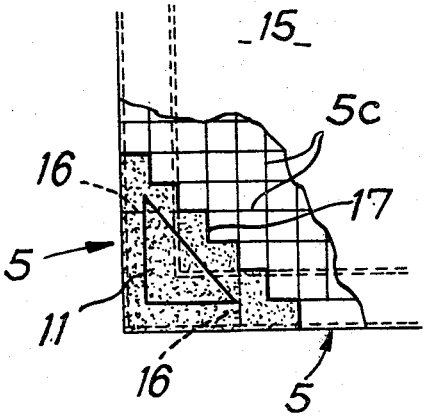
FIG. 4 illustrates the fixing of a first type of ceiling of the modular element according to the invention on the vertical walls of FIGS. 2 and 3.

FIG. 4 illustrates the joining of a ceiling 15 made of composite material similar to that of the walls 5, to said walls. This ceiling has also been prepared so as to present a recess plumb with the free space presented by two vertical walls 5 at the level of their adjacent edges, said cut-out being identical in surface to the section of this free space. The network of cross-pieces 5*c* contained in the ceiling is also raked away near this cut-out, so as to create a free space, whose volume is greater than the volume of said cut-out. In this Figure, the cut-out is marked by the broken line 16, the raking out being limited to the solid lines 17. Means for retaining the binding agent at the level of the edges of said ceiling will have been provided, which, cast during the joining of the walls, forms a gusset inside the ceiling, which allows its anchoring and maintenance on the vertical walls 5.

In FIG. 5, the walls 5 are also made of "Placoplatre" and part of the network of cross-pieces 5*c* has been removed to make an upper horizontal space 18 which may run along the whole of the walls of the modular element. The space 18 is filled when the binding agent is cast and forms the upper tying of the element operating as an armour belt.

In the case of this Figure, the ceiling of the element is constituted by a single panel 19, nailed to joists 20, said panel and said joists being, moreover, connected to the upper part of the vertical walls either by being taken in the tying or by any other means.

FIG. 6 shows the modular element according to the invention equipped with a facade panel 7. This facade panel rests on a projecting part 1*a* of the slab 1 via centering members 21 and is coupled to one of the projecting parts 22*a* of stiffeners 22 provided in the ceiling 15, by means of a horizontal member 23 passing through said projecting part. The adjustment and fastening of the member 23 on the projecting part 22*a* are ensured for example by two nuts such as 24 cooperating with the threaded end of the member 23. This arrangement enables the verticality of the facade panel 7 to be adjusted simply. This Figure shows that the facade panel 7 determines with wall 5 a space 8 serving, on the one hand, to improve the insulation of the inside of the modular element with respect to the outside medium and, on the other hand, to dispose cross-pieces (not shown) previously fixed to the facade panel and coupled to the walls 5 in known manner. The member 23 and the bolts 24 may cooperate in the same manner with the joists 20 of a ceiling according to FIG. 5.

FIG. 7*a* shows, by a section, the shape of the outer edge 7*a* of the facade panel 7. This edge 7*a* is provided with a groove 25 from the bottom of which issue fastening means such as 26 having eyes 27. These fastening means are at least two in number, disposed respectively at the top and bottom of the edge 7*a* of the facade panel. They may cooperate with corresponding fastening means in the edge of a facade panel outlined at 7′ carried by a modular element disposed at the side of the one equipped with the facade panel 7. As shown in FIG. 7*b*, the hooking of a fastening means 26 with its corresponding one 26′ carried by the facade panel 7′ is effected by means of a bevelled pin 28, acting as a wedge between the eyes 27 and 27′, the effect of which, during its penetration, causes the facade panels, thus the adjacent modular elements, to move closer together until the edges such as 7*a* and 7′*a* provided with gaskets make contact. The actuation of the pin 28 is effected by the upper edge of the facade panels by means, for example, of a rod dismountably coupled to the upper part of this pin. Any other means may be employed for bringing together and joining two consecutive facade panels, particularly extensible taper pins.

Figure 8A:
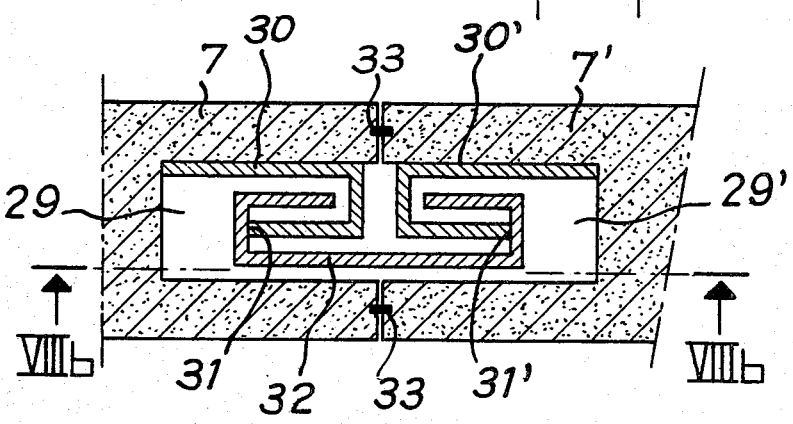
Figure 8B:
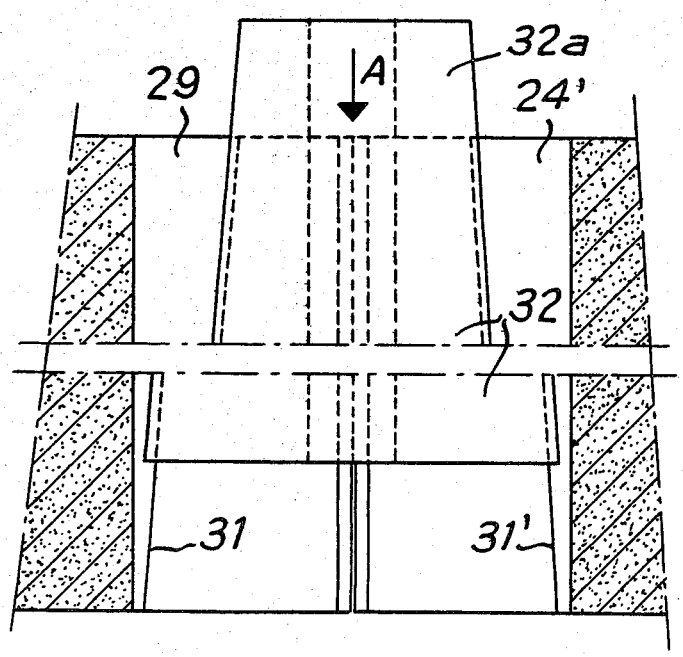

FIGS. 8*a* and 8*b* illustrate a variant embodiment of the above-mentioned system of joining. Thus, each of the panels 7 and 7′ is provided, in a housing 29, 29′ provided to this end on its edge, with metallic grooves 30 and 30′ which are fast therewith. The edges 31 and 31′ of the flanges of these grooves taper and a metallic pin 32 of the same inclination may overlap thereon. By driving this pin in the direction of arrow A, the two panels 7 and 7′ tend to move closer and gaskets 33 placed on their edges are crushed. This moving together being effected, the part 32*a* located above panels 7, 7′ is cut. This device has the advantage of being very simple, requiring no adjustment and of taking into account all the dimensional imperfections of manufacture.

Figure 9:
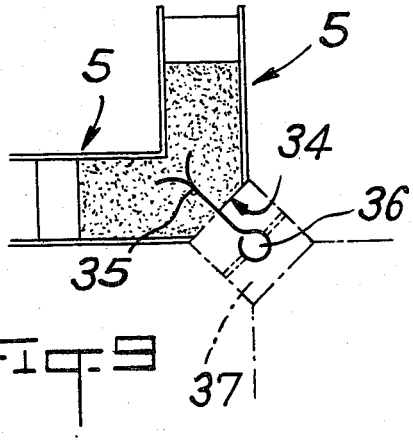

Finally, FIG. 9 shows the angle of a modular element according to the invention, which is not adjacent a facade panel. This angle has a chamfered edge 34, from which issue at least two fastening means in said element, as shown at 35. These fastening means also have an eye 36. When four modular elements are disposed as shown by the broken lines of FIG. 9, the eyes 36 are aligned and a locking rod may be introduced into each of them. The free volume such as 37 surrounding said eyes and the rod may be filled with cement to perfect the coupling of the modular elements.

The modular element according to the present invention has the advantage of using inexpensive materials which may easily be prepared, in standardised manner, in advance in the factory and also easily be assembled in the factory. The materials used and assembled according to the invention also allow any water, electricity and gas pipe or lead to be placed easily and rapidly inside the composite panels forming the ceiling and vertical walls of the modular element. Such an element may therefore arrive on the site completely finished, the operations still to be carried out being solely the joining together of the modules and the positioning of a roofing, which may also be modular.

The overall width of such an element will advantageously be no more than the maximum width allowed for conventional road transport.

The invention finds advantage application in the construction of dwellings.

What is claimed is:

1. A modular element for use in the construction of dwellings comprising, a floor, a ceiling and vertical walls extending between the floor and the ceiling to define at least one parallelepipedic box-shaped compartment, said floor having a plurality of corners and comprising a reinforced concrete slab, a layer of supple material placed on and covering said slab, and a false floor positioned on said supple material for relative movement with respect to said slab, said vertical walls being rigidly connected at their base to said flase floor for movement therewith, and releasable fixing means connected between said slab and said false floor, at least in each of the corners of the element, for selectively fixing the slab to the false floor when the element is in its final position in use and for permitting limited relative movement therebetween when the element is being transported to a construction site whereby excess loads imposed on the floor slab during transport are absorbed in said supple material without being transmitted to said false floor or said vertical walls.

2. The element as recited in claim 1, including a plurality of jacks respectively located at and secured to the corners of the floor slab for supporting the element on a support structure at the construction site.

3. A modular element for use in the construction of dwellings comprising, a floor, a ceiling and vertical walls extending between the floor and the ceiling to define at least one parallelepipedic boxshaped compartment, said floor having a plurality of corners and comprising a reinforced concrete slab, a layer of supple material placed on and covering said slab, and a false floor positioned on said supple material, said vertical walls being rigidly connected at their bases to said false floor, and releasable fixing means connected between said slab and said flase floor, at least in each of the corners of the element; said vertical walls being formed of composite material comprising two spaced panels and a network of internal reinforcement cross-pieces extending therebetween, said walls being connected together by vertical posts cast and solidified in spaces made in each of the adjacent edges of adjacent walls by partial raking away of the network of cross-pieces, and means for connecting the walls to the false floor comprising fastening means fixed to the false floor, a reinforcement placed in a space made at the base of said walls and receiving said fastening means and a solidifiable binding agent filling said space and surrounding said fastening means and reinforcement in said space.

4. The element as recited in claim 3, wherein said posts are reinforced.

5. The element as recited in claim 3, wherein the ceiling is constituted by a composite material comprising two plates between which extends an internal reinforcement constituting a network of cross-pieces the said posts extending at their top in a space made in said ceiling by partial raking away of its network of cross-pieces so as to form a gusset for connection of the ceiling to the vertical walls.

6. The element as recited in claim 3, wherein the ceiling is provided with stiffeners projecting on its upper face.

7. The element as recited in claim 3, wherein said walls are connected at their upper part by a tying cast and solidified in a space made by partly raking away the inner reinforcement.

8. The element as recited in claim 2, wherein the vertical walls are obtained in one piece by casting on the layer provided with fastening means.

9. The element as recited in claim 2, wherein the ceiling is constituted by a panel carried by joists.

10. The element as recited in claim 1, wherein a facade panel is erected along a vertical wall, is anchored at its base on a part projecting from the slab and defines with said wall a zone of insulation.

11. A modular element for use in the construction of dwellings comprising, a floor, a ceiling and vertical walls extending between the floor and the ceiling to define at least one parallelepipedic box-shaped compartment, said floor having a plurality of corners and comprising a reinforced concrete slab, a layer of supple material placed on and covering said slab, and a false floor positioned on said supple material, said vertical walls being rigidly connected at their bases to said false floor, and releasable fixing means connected between said slab and said false floor, at least in each of the corners of the element; and a facaded panel erected along a vertical wall, said facaded panel being anchored at its base on a portion of the slab extending beyond the false floor and defining with the adjacent vertical wall or zone of insulation; said ceiling including stiffeners and/or joists therein; and said facade panel includes, at its upper edge, at least one horizontal member positioned to cooperate with one of the stiffeners or joists of the ceiling and means operatively engaged between said horizontal member and said stiffener or joist cooperating therewith for adjusting and fixing the facade panel with respect to the corresponding adjacent vertical panel.

12. The element as recited in claim 11, wherein the side edges of said facade panel are shaped as grooves whose edges are equipped with gaskets and from the bottom of which issue fastening means for connecting two consecutive modular elements.

13. The element as recited in claim 12, wherein the corresponding fastening means of two consecutive modular elements comprise eyes in which a common connecting element in the form of a wedge is introduced.

14. The element as recited in claim 11, wherein the sides of said facade panel are provided with bevelled gaskets and slides, recessed with respect to the gaskets, in which a vertical taper pin may be forcibly driven.

15. The element as recited in claim 10, wherein each corner of the element not adjacent a facade panel has a chamfered outer edge from which issue fastening means for connecting adjacent modular elements.

16. The element as recited in claim 15, wherein each of said fastening means has an eye at a determined length, so that the eyes of the fastening means carried by the adjacent modular elements are plumb with one another, a connecting rod being adapted to be introduced into all the eyes and a binding agent being cast in the space freed by the chamfered edges.

* * * * *